United States Patent [19]

Bakos et al.

[11] 4,392,617

[45] Jul. 12, 1983

[54] SPRAY HEAD APPARATUS

[75] Inventors: Peter Bakos; Russell E. Darrow, both of Endicott; Joseph Funari, Vestal; Diane L. Redpath, Endicott, all of N.Y.

[73] Assignee: International Business Machines Corporation, Armonk, N.Y.

[21] Appl. No.: 278,025

[22] Filed: Jun. 29, 1981

[51] Int. Cl.[3] ..... B05B 1/26

[52] U.S. Cl. ..... 239/290; 239/382; 239/424.5

[58] Field of Search ..... 239/294, 296, 300, 102, 239/115, 117, 382, 424, 424.5

[56] References Cited

U.S. PATENT DOCUMENTS

| | | | |
|---|---|---|---|
| 1,279,315 | 9/1918 | Foerst . | |
| 1,655,254 | 1/1928 | Binks . | |
| 1,703,383 | 2/1929 | Birkenmaier . | |
| 1,737,896 | 12/1929 | Shelburne . | |
| 1,812,234 | 6/1931 | Braatelien . | |
| 2,101,175 | 12/1937 | Gustafsson | 299/140.1 |
| 2,126,888 | 8/1938 | Jenkins | 299/140.1 |
| 2,138,300 | 11/1938 | Gustafsson | 299/140.1 |
| 2,351,787 | 6/1944 | Smith | 158/27.4 |
| 2,504,216 | 4/1950 | Morton | 239/296 |
| 2,612,408 | 9/1952 | Kurata | 299/125 |
| 2,743,963 | 5/1956 | Peeps | 299/140.1 |
| 3,275,248 | 9/1966 | O'Brien et al. | 239/487 |
| 3,473,735 | 10/1969 | Drum | 239/15 |
| 3,542,293 | 11/1970 | Bishop et al. | 239/95 |
| 3,672,569 | 6/1972 | Smead et al. | 239/15 |
| 3,747,850 | 7/1973 | Hastings et al. | 239/3 |
| 4,273,293 | 6/1981 | Hastings | 239/424 |

FOREIGN PATENT DOCUMENTS

| | | |
|---|---|---|
| 26575 | of 1912 | United Kingdom . |
| 367014 | 3/1932 | United Kingdom . |

OTHER PUBLICATIONS

Advertisement–Electronic News, Monday, May 11, 1981, p. V.

*Primary Examiner*—John J. Love
*Assistant Examiner*—Jon M. Rastello
*Attorney, Agent, or Firm*—Norman R. Bardales

[57] ABSTRACT

An elongated member is provided in the discharge orifice of a spray head nozzle so that the fluid being sprayed is discharged as a hollow stream resulting inter alia in a better and more complete atomization of the fluid in coaction with a low pressure propellant.

5 Claims, 14 Drawing Figures

SPRAY HEAD APPARATUS

BACKGROUND OF THE INVENTION

1. Field of the Invention

This invention relates to spray head apparatus and more particularly to spray head apparatus utilizing a pressurized propellant.

2. Description of the Prior Art

The use of pressurized propellants in spray systems to atomize the the material being sprayed is well known to those skilled in the art. It has been found that high pressure propellant systems are not suitable for certain applications such as where, for example, it is desired to spray a uniform and/or very thin layer of the material. This is mainly because a high pressure system tends to blow away the material in the layer as it is being formed by the spray. Accordingly, it is the custom in these type applications to use a low pressure propellant system to minimize or mitigate the deleterious effects of a high pressure propellant system.

For example, in the production of photoresist masks used in the manufacture of printed circuits and/or integrated circuits, the mask is made by initially depositing a continuous photoresist layer on the surface of the workpiece intended to be worked with the mask when the mask is subsequently finalized. The mask is then produced from the layer using well known photolithographical techniques. One known way of depositing the layer in the prior art is to spray on the resist. The spray is formed from a discharging stream of liquid photoresist that is atomized by a low pressure propellant system. If the resist is sprayed on with a high pressure propellant, discontinuities in the resist layer occur as the result of being blown away by the propellant as the layer is being deposited. Consequently, the continuity of the resist layer and hence the integrity of the mask subsequently formed therefrom and/or of the resultant circuitry produced with the mask are adversely effected. The use of a low pressure propellant is thus more suitable for such an application.

Heretofore, in a known spray head apparatus of the prior art, a stream of photoresist fluid is discharged from the unobstructed orifice of a nozzle. On exiting from the orifice, the stream is intercepted by a low pressure propellant, e.g. filtered nitrogen gas, and the resultant turbulence atomizes the photoresist thereby forming the spray. However, it was found that the turbulence was less effective in atomizing the resist at the core or center of the stream than at the periphery of the stream. Thus, within the zone or region formed by the spray, the resist tended to be more thickly deposited at the center of the spray zone than at the periphery. Hence, the prior art apparatus was not conducive to forming a layer of substantially uniform thickness. The problem is even more acute where the thickness of the deposited resist layer approaches the range of forty micro-inches or less. As is well known to those familiar with the art, non-uniformities in the resist layer adversely affects the electrical characteristics of the resultant circuit elements produced with the subsequently formed mask. For example, it can be readily appreciated by those skilled in the art that if the mask is to be used to etch a metallization layer which is eighty thousand angstrom thick into a conductor pattern of plural one mil wide conductors with a minimum spacing of three-tenths of a mil between conductors, a resist layer of non-uniform thickness can result in such adverse characteristics as open or short circuited conductors, and/or non-uniform impedance characteristics of the conductor lines, etc.

Moreover, the orifice of the nozzle of the aforedescribed prior art spray head apparatus was susceptible to clogging which caused diversion of the stream from its designed, i.e. intended, direction and/or further adversely affected the atomization of the stream. As a result, the direction of the spray was also diverted and consequently the spray did not intercept the member being sprayed at the desired location coordinates.

Hence, the aforedescribed prior art spray head apparatus was not readily controllable nor conducive to spraying a resist layer with a reliable uniform thickness, and/or adversely affected the reliability of the subsequently formed therefrom photomask and/or the circuitry thereafter produced from the mask.

It should be understood that in the past elongated pin-like members have been associated with atomizing nozzles and spray devices, cf. U.S. Pat. Nos. 1,812,234 and 2,612,408, and United Kingdom Pat. No. 26,575, A.D. 1912, for example. However, of the prior art of which we are aware, none provide the structural means for discharging the material to be sprayed as a hollow-shaped stream and/or in combination with a pressurized propellant system in accordance with the principles of the present invention as hereinafter described.

SUMMARY OF THE INVENTION

It is an object of this invention to provide improved spray head apparatus which sprays a layer of substantially uniform thickness.

It is another object of this invention to provide spray head apparatus which produces a reliable and controllable spray.

Still another object of this invention is to provide spray head apparatus in combination with a low pressure propellant system that produces a reliable and controllable spray and/or a sprayed layer of substantially uniform thickness.

It is still another object of this invention to provide spray head apparatus which sprays a resist layer with a substantially uniform thickness in a reliable and/or controllable manner, and/or which is particularly useful for the production of resist masks used in the manufacture of printed and integrated circuitry and the like.

According to one aspect of the invention, a spray head apparatus is provided with nozzle means with at least one discharge orifice for discharging a predetermined fluid. Means are provided for discharging the fluid from the orifice as a hollow-shaped stream. A source of pressurized propellant is also provided. The pressurized propellant intercepts the discharged fluid external to the orifice. The means for discharging the fluid from the orifice as a hollow-shaped stream coacts with the propellant to atomize the fluid into a spray having at least one predetermined controlled characteristic.

The foregoing and other objects, features and advantages of the invention will be apparent from the more particular description of the preferred embodiment of the invention, as illustrated in the accompanying drawing.

BRIEF DESCRIPTION OF THE DRAWING

In the figures, like elements are designated with similar reference numbers.

DESCRIPTION OF THE PREFERRED EMBODIMENT

Figure 1:
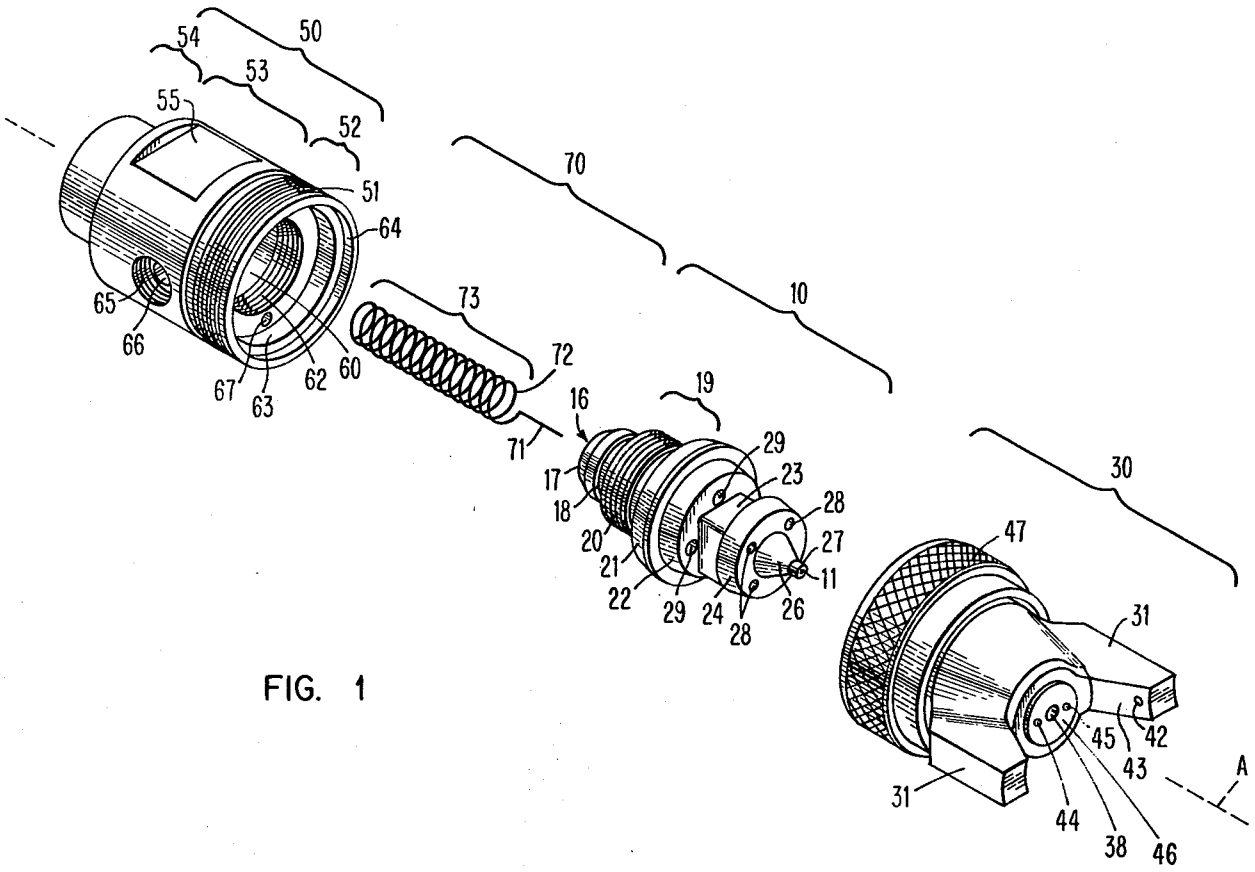
FIG. 1 is an exploded perspective view of a preferred embodiment of the spray head apparatus of the present invention.

Referring to FIGS. 1–8, there is shown a preferred embodiment of the spray head apparatus of the present invention. It has a nozzle 10 with a discharge orifice 11 from which is discharged a predetermined fluid, not shown, to be sprayed. In the preferred embodiment, the spray head apparatus preferably sprays a liquid photoresist of the type used to make photomasks in the manufacture of printed and integrated circuits.

The inner configuration of nozzle 10 has a slightly elongated cylindrical-shaped small diameter bore 12. It terminates as the circular orifice 11 at its lower end as viewed facing FIG. 3. The upper end of bore 12 interfaces with the substantially equally sized small diameter opening of the funnel-shaped bore 13. Interfaced with the large diameter opening of bore 13 is the lower end of the longer cylindrical-shaped bore 14. The diameter of bore 14 is substantially the same size as that of the large diameter opening of the bore 13. The upper end of bore 14 in turn interfaces with the substantially equal sized small diameter opening of a short funnel-shaped bore 15. The upper end of bore 15 terminates in a slightly larger diameter circular opening 16. Elements 11–16 are symmetrically aligned and are concentric with central axis A. The fluid, not shown for sake of clarity, to be sprayed enters the nozzle 10 thru opening 16, passes sequentially thru bores 15, 14, 13 and 12 and from thence is discharged from orifice 11.

Figure 3:
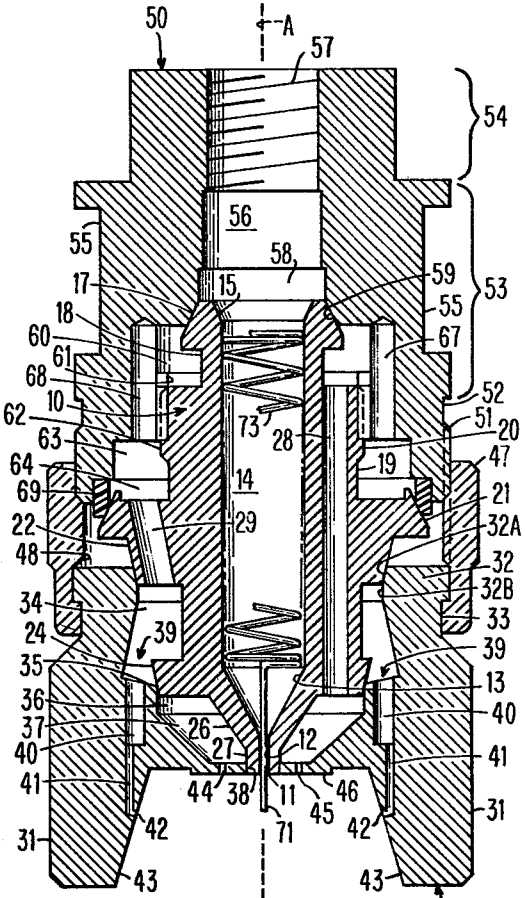
FIG. 3 is a cross-sectional view of the apparatus of FIG. 1 corresponding to FIG. 2 but illustrating the components thereof in assembly.
Figure 4:
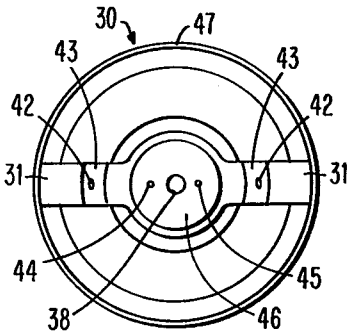
FIGS. 4–8 are respective end views of various components of the apparatus of FIG. 1 taken along the lines 4—4, 5—5, 6—6, 7—7 and 8—8, respectively, of FIG. 2.
Figure 5:
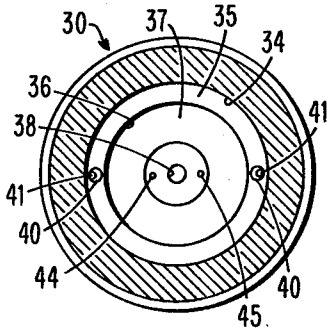
Figure 6:
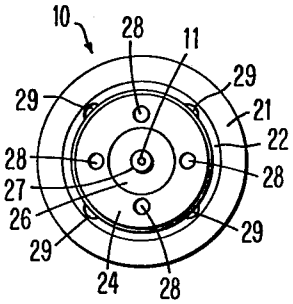
Figure 7:
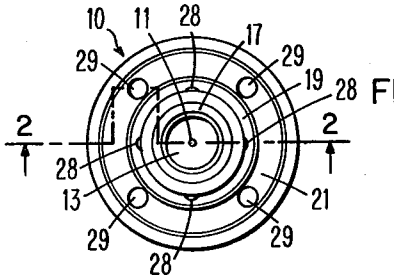
Figure 8:
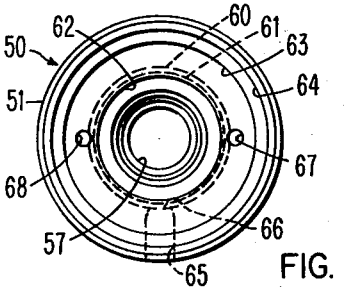

The outer configuration of nozzle 10 has a truncated cone-shaped sealing flange 17 at its upper end as viewed facing FIG. 3. Beneath flange 17 is a cylindrical-shaped recess 18 followed by a cylindrical-shaped section 19 which is partially threaded, cf. threads 20, at its top. An enlarged diameter truncated cone-shaped flange 21 is located near the central portion of nozzle 10 and beneath which is a smaller diameter flange 22. Flange 22 has an inverted truncated cone shape. The next section 23, which has a square-shaped cross-section resulting in four flat outer sides, lies between flange 22 and the inverted truncated cone-shaped flange 24. The funnel-shaped bottom portion 25 of nozzle 10 includes the truncated cone-shaped section 26 and cylindrical-shaped tip 27 extended therefrom. It should be understood that the elements 17–27 of the outer configuration are in symmetric alignment and concentric with the axis A.

Passing thru the nozzle 10 are four vertical cylindrical-shaped inner ducts 28. Ducts 28 extend from the top of section 19 to the bottom of flange 22 and are parallel to axis A. Four outer cylindrical ducts 29, which are inclined in a downward manner towards axis A, pass thru the nozzle 10 extending from the top of flange 21 to the bottom of flange 22. Ducts 28 and 29 are angularly symmetrically disposed about axis A, cf. FIGS. 6 and 7. For sake of clarity, it should be understood that in the cross-sectional views of FIGS. 2 and 3, the nozzle 10 is viewed along the line 2—2 of FIG. 7 to illustrate one of the outer ducts 29. The ducts 28–29 are part of a propellant delivery network or source which provide a low pressure propellant external to orifice 11, as hereinafter described in greater detail.

More particularly, the aforementioned propellant source also includes a lower hollow member 30, hereinafter sometimes referred to as a spreader. The lower part of member 30 has a generally inverted truncated cone-shaped outer configuration with a pair of integral wing-like parts 31 that are diametrically aligned with respect to each other and coplanar with the axis A. The upper part of the outer configuration of member 30 is a circular flange 32 and its intermediate part is a cylindrical-shaped recess 33.

The inner configuration of member 30 begins with the beveled rim 32A of the cylindrical-shaped opening 32B of flange 32. Next, is an inverted truncated cone-shaped section 34, its upper end being interfaced with the opening 32B of flange 32. The lower end of section 34 interfaces with the beveled rim 35 of the cylindrical-shaped bore 36. Next, a truncated cone-shaped bore 37 terminates in a center circular opening 38. The symmetrically aligned truncated cone-shaped outer part of member 30 and the flange 32, and the symmetrically aligned inner configuration elements 32A, 32B, 33–38 are concentric with axis A.

A pair of ducts 39 are located in the wing-like parts 31. More particularly, each duct 39 includes an upper vertical bore 40 which extends downwardly from the beveled rim 35 and partially into one of the parts 31. Each bore 40 interfaces with an aligned vertical reduced diameter bore 41 which is part of the associated particular duct 39. Each vertical bore 41 in turn interfaces with a downwardly inclined bore 42. The two bores 42 extend to the respective outer surfaces of the sides 43, which are in aligned facing relationship. Ducts 39 are associated with the aforementioned propellant network.

Also associated with the propellant network are two ports 44 and 45 which are symmetrically located about opening 38. All three elements 38, 44, 45 are located on the bottom side 46 of member 30. Ducts 39 and ports 44 and 45 are substantially symmetrical and coplanar with axis A.

Engaged about the outer rim of flange 31 in a turnable manner is a knurled coupling ring 47 having inner threads 48. Ring 47 has a large central opening 49 thru which extends the lower part of nozzle 10, i.e. the part beneath flange 21. Ring 47 thru its threads 48 is connectible to the hollow fitting 50 via the latter's threads 51. Threads 51 are located at the bottom of the cylindrical-shaped lower section 52 of the outer configuration of fitting 50 of the spray head apparatus.

The middle and upper sections 53 and 54, respectively, of the outer configuration of fitting 50 are also cylindrically shaped, sections 52–53 being concentrically aligned with the axis A. A pair of diametrically opposed flats 55 are provided on the surface of section 53 for coaction with the jaws of an appropriate tool, not shown, e.g. a wrench, to facilitate the mounting or demounting of the head to other external fittings, not shown.

The inner configuration of fitting 50 has an upper cylindrical-shaped bore 56 which is partially threaded, cf. threads 57 at the top of bore 56. Beneath bore 56 is a slightly larger diameter cylindrical-shaped bore 58, which acts as a stop for the rim 16 of nozzle 10. A truncated cone-shaped bore 59 lies between bore 58 and the enlarged diameter cylindrical-shaped bore 60. Beneath bore 60, there is a reduced diameter cylindrical-shaped bore 61, which is provided with threads 62 that coact with the threads 20 of nozzle 10. Bore 61 is followed by successively increased diameter cylindrical-shaped bores 63–64. Bores 56, 58–61, 63,64 are in symmetrical alignment and concentric with axis A.

A threaded radial opening 65 extends from the outside surface of fitting 50 and terminates into a reduced sized opening 66 in the wall formed by inner bore 60. Two vertical diametrically opposed bores 67,68 extend upwardly from bore 63, thru bore 61, and interface with the opening formed by bore 60. Elements 60–63, 65–68 are also part of the propellant delivery network, as will be explained in the following description of the assembly of the nozzle 10, member 30, and fitting 50.

In particular, nozzle 10 is assembled to the fitting 50 by the threaded engagement of their respective threads 20 and 62. When nozzle 10 is drawn up the fitting 50 by the co-action of the threads 20 and 62, a mechanical seal is effected between the tapered respective surfaces of the nozzle's flange 17 and the fitting's bore 59 thereby preventing leakage between the fluid delivery system and the propellant delivery system. Appropriate tools, e.g. wrenches, applied to the flats 55 and a pair of opposite flat sides of the nozzle's section 23 may be used to facilitate the assembly and aforementioned seal.

Figure 2:
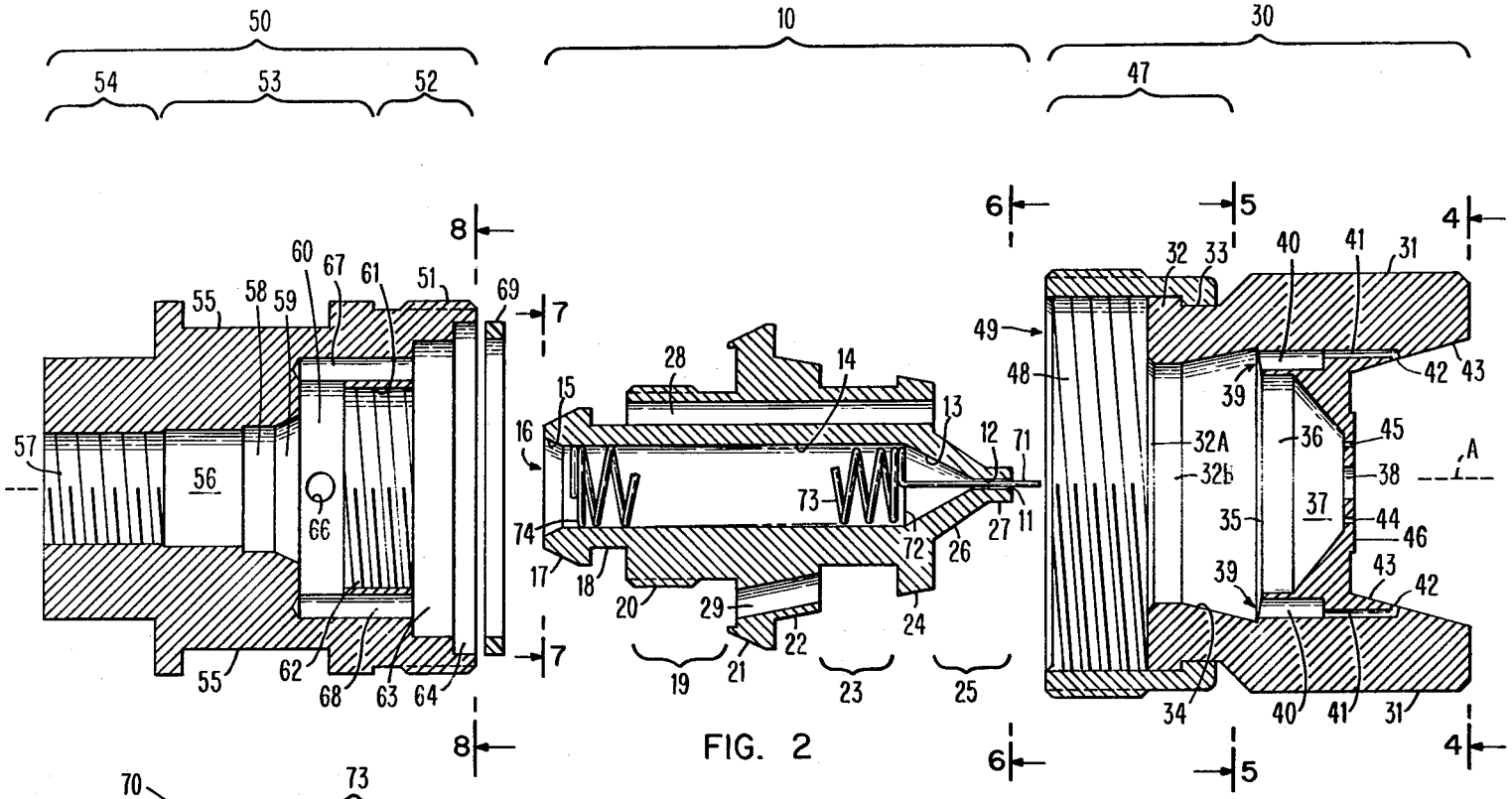
FIG. 2 is an exploded cross-sectional view of the apparatus of FIG. 1.

Member 30 is assembled or mounted to the fitting 50, which has the nozzle 10 mounted therein as aforedescribed, by the engagement of the threads 48 of the coupling ring 47 of member 30 with the threads 51 of fitting 50. A pliable, e.g. polyurethane, ring-shaped sealing gasket 69, FIGS. 2–3, is located in the bore 64. When ring 47, and hence member 30, is drawn up the fitting 50 via the coaction of the threads 48 and 51, the sealing gasket 69 is compressed between the nozzle's flange 21 and the wall of the fitting's bore 64 thereby effecting the seal. In addition, as the ring 47 is drawn up fitting 50, it also effects a mechanical seal between the nozzle's flange 22 and sealing rim 32A of member 30, and a mechanical seal between the nozzle's flange 24 and edge of the beveled rim 35 of member 30. When the nozzle 10 is assembled in member 30, the planar face of the tip 27 of nozzle 10, i.e. the outer planar face of tip 27 which is coplanar with the the orifice 11, is substantially coplanar with the outer surface of the bottom side 46 of member 30.

A supply, not shown, of liquid photoresist is connectible to the fitting 50 thru an external threaded pipe fitting, not shown, that fits the threads 57 of bore 56. Likewise, a low pressure supply, not shown, of an inert gas propellant, preferably nitrogen, is connectible to the fitting 50 thru another external pipe fitting, not shown, that fits the threaded opening 65, which is in communication with bore 60.

The liquid resist thus enters fitting 50 thru bore 56, passes then thru bore 58 and then directly into the nozzle 10 from where it is discharged from the orifice 11 as previously described. Reiterating, the fluid delivery system is sealed off from the propellant delivery system in bore 60 by the seal effected between bore 59 of fitting 50 and the flange 17 of nozzle 10.

The propellant on the other hand enters fitting 50 thru the bore 60 via opening 66. From there the propellant is delivered external to the orifice 11 thru two sub-networks, which are substantially sealed off from each other as well as from the aforementioned fluid or resist delivery system that delivers the resist to orifice 11. In one sub-network, the propellant is delivered from the sealed off bore 60 of fitting 50 via the four ducts 28 of nozzle 10 to the bore 36 and from thence to the bore 37. From there the propellant is fed external to orifice 11 thru the ports 44 and 45 and the space between the tip 27 of nozzle 10 and the wall formed by the opening 38 in the bottom side 46 of member 30.

In the other propellant delivery sub-network, the propellant is delivered from bore 60 thru the two vertical bores 67, 68 to the bore 63 and from there to the bore 64, which is sealed off by gasket 69 to prevent its external leakage thereat. From bore 64 of fitting 50, the propellant passes thru the four inclined ducts 29 of nozzle 10 and into the cylindrical-shaped opening 32B of flange 32. Flange 22 of nozzle 10 coacting with the seal rim 32A of the opening 32B prevents external leakage thereat of the propellant. From opening 32B the propellant passes thru bore 34 and into the two ducts 39. It should be noted that flange 24 and the edge of bevel rim 35 coact to seal off the two propellant sub-systems and in particular seal off bores 34 and 36 from each other. The propellant in ducts 39 is then fed external to the orifice 11 as it passes outwardly from the inclined bores 42.

It should be understood that the components 10–69 and their aforedescribed assembly are known in the prior art, and that they are used herein in connection with description of the preferred embodiment for sake of clarity in illustrating the principles of the present invention.

Figure 2A:
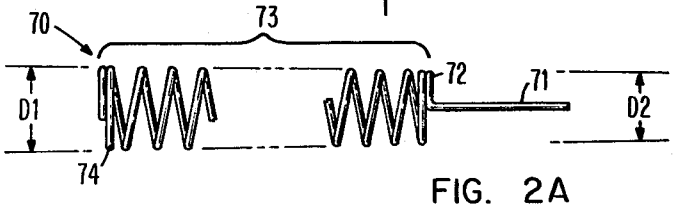
FIG. 2A is a side elevation view of a component of the apparatus of FIG. 1.

Heretofore, in the aforedescribed prior art assembly 10–69, the fluid was discharged from the orifice 11 as a solid stream. In accordance with the principles of the present invention, however, the fluid is discharged as a hollow-shaped stream by means generally indicated by the reference number 70, cf. FIG. 2A. In the preferred embodiment, means 70 has an outwardly extended elongated member 71 disposed in the orifice 11. The fluid as it is discharged from the orifice 11 flows along the elongated member 71 forming a hollow-shaped stream due to the presence of the member 71 in the center of the stream. The propellant, upon exiting from the two side bores 42 and the two ports 44–45 and the space formed between the nozzle tip 27 and the wall formed by the opening 38 of member 30, intercepts the fluid stream. The elongated member 71 coacts with the intercepting propellant to atomize the fluid into a spray having at least one predetermined controlled characteristic, as hereinafter explained.

Furthermore, preferably the member 71 is vibratile. As such, the intercepting propellant and/or discharging fluid sets the member 71 in vibration thereby further enhancing the atomization of the spray and/or providing a self-cleaning action of the orifice 11 thereby preventing clogging or obstruction thereof.

In the preferred embodiment, the member 70 is a metal wire coil spring and the straight section member 71 is integral with the end coil 72. Member 71 is aligned with the central axis of the coil section 73. The length of the coil section 73 is compatible with the length of the bore 14 of nozzle 10 in which it is housed. By judiciously selecting the diameter D1 at the remote end 74 of section 73 to be slightly greater than the diameter D2 at its other end which is proximate to coil 72, and such that diameters D1 and D2 are greater than the diameter of bore 14, the coils of section 73 can be temporarily radially compressed for insertion of the member 70 in the bore 14 through opening 16 and such that the end 71 passes thru the bore 12 and extends outwardly from orifice 11. After insertion, the coils are relieved of the temporary compression, allowing the coils to expand and the member 70 to be held substantially firmly in place within the nozzle 10. Thereafter, the nozzle 10 may be assembled to the fitting 50 and the member 30 subsequently connected to the nozzle-mounted fitting 50 similar to the manner previously described.

Figure 9:
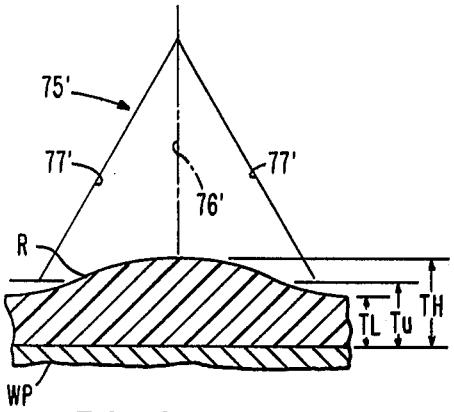
FIG. 9 (PRIOR ART)
FIGS. 9 and 10 are comparative schematic cross-sectional views of respective layers produced from the sprays of a spray head apparatus of the prior art and the apparatus of FIG. 1, respectively.

Referring to FIG. 9, there is shown the results of using the prior art photoresist spray head assembly 10–69, which does not include member 70 and in particular the member 71 thereof of the present invention. Accordingly, the turbulence of the intercepting propellant is less effective in atomizing the resist at the core or center of the solid stream than at the periphery of the stream. Thus, within the zone 75' or region formed by the spray, the resist R tended to be more thickly deposited on the workpiece WP, e.g. a conductive metal layer, at the center 76' of the spray zone 75' than at its periphery 77'. Hence, the prior art apparatus was not conducive to depositing a layer of substantially uniform thickness Tu but resulted in depositing a non-uniform layer of low and high thicknesses TL and TH as shown in FIG. 9.

Figure 10:
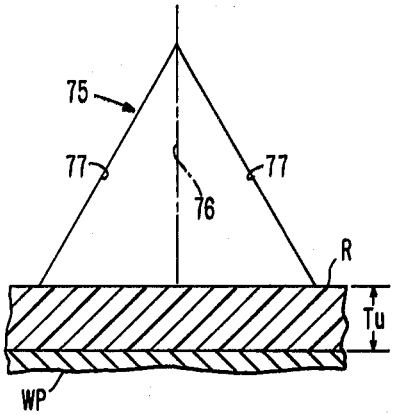

On the other hand, as shown in FIG. 10, when the member 71 is used in combination with the members 10–69 in accordance with the principles of the present invention, the resist R is deposited in a layer with a substantially uniform thickness Tu across the entire spray zone 75, i.e. from the center 76 to the periphery 77 of the zone 75. Thus, the spray head apparatus of the present invention is able to provide a spray with a controlled characteristic.

Figure 11:
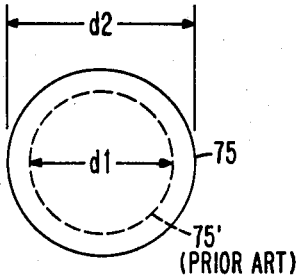
FIG. 11 is a schematic plan view illustrating by way of comparison the respective relative sizes of the sprays of a spray head apparatus of the prior art and the apparatus of FIG. 1.

Moreover, when the member 71 is vibratile as is preferred, it provides other controlled characteristics. For example, it substantially increases the size of the spray zone. Thus as shown in FIG. 11, the diameter d1 represents the relative size at the base of the resultant spray zone 75' of the prior art assembly 10–69; whereas, the diameter d2 represents the increased size at the base of the spray zone 75 of the assembly 10–69 when using the member 71, both zones 75 and 75' having substantially equal altitudes or heights. For example, a diameter ratio d2/d1 of 8/5 has been obtained using a spray head with and without the member 71.

Figure 12:
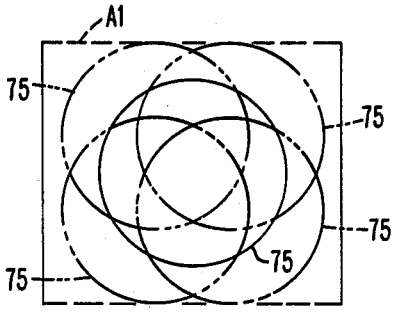
FIG. 12 is a schematic plan view illustrating the area covered by the spray of the apparatus of FIG. 1.

Moreover, by using the vibratile member 71, a larger effective and controllable area A1 as shown in FIG. 12 can be sprayed with the concomitant deflections of the spray zone produced in response to the vibrations, than otherwise would be the case if the spray was stationary such as is the case when a non-vibratile member 71 is employed or when a member 71 is not used.

Figure 13:
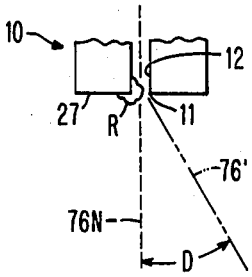
FIG. 13(PRIOR ART)
FIG. 13 is a partial cross-sectional view of the orifice and tip of the spray head apparatus of the prior art illustrating the effects of clogging thereof.

Referring to FIG. 13, there is shown the clogging of the orifice 11 of a prior art asesembly 10–69 by some photoresist R that has dried out thereat and the resultant deflection D of the center 76' of the resultant spray produced thereby from its intended normal direction 76N. However, as previously explained when the prior art assembly 10–69 is combined with the vibratile member 71, the orifice 11 is effectively prevented from clogging by the vibrations and resulting cleaning action thereof, and thus the spray direction, i.e. orientation, is more readily controllable and not adversely affected.

Thus, as is apparent to those skilled in the art, the present invention apparatus is readily controllable and conducive to spraying a resist layer with a reliable uniform thickness, and/or providing improved reliability of the subsequently formed therefrom photomask and/or the circuitry thereafter produced from the mask. Moreover, by being vibratile it can provide a more controlled and reliable spray size and/or spray direction.

Typical parameters for the spray head apparatus of FIGS. 1–8 are indicated in the following table:

TABLE

| | |
|---|---|
| Diameter of orifice 11 | 0.020 in. |
| Diameter of member 71 | 0.010 in. |
| Length of member 71 | 0.410 in. |
| Rate of discharge of resist | 20 cc/min. |
| Pressure of propellant | 8 psi |

In addition to the alternatives, changes and/or modifications heretofore described, other alternatives, changes and/or modifications to the apparatus of the present invention are possible as is apparent to those skilled in the art. Thus, in those applications where the depositing of a layer of uniform thickness is the only critical concern, the member 71 need not be vibratile. Moreover, while the apparatus has been described with particular components and having particular configurations and symmetry, other components having other configurations and symmetry and/or asymmetry may be used. Furthermore, multiple orifices and/or other arrangements of the fluid delivery system and/or the propellant delivery system including additional or less ducts or ports may be used. Moreover, the invention is applicable to other pressure propellant systems and/or other type fluids to be sprayed, as is apparent to those skilled in the art. In addition, it should be understood the invention is applicable to other spray applications such as painting, for example.

Thus, while the invention has been described with reference to preferred embodiments thereof, it will be understood by those skilled in the art that various changes in form and details may be made without departing from the scope of the invention.

We claim:

1. Non-electrostatic spray head apparatus for spraying a layer of photoresist material on the surface of a predetermined circuitizable workpiece, said layer being subsequently finalized as a photoresist mask for coacting with said surface to circuitize said workpiece, said apparatus comprising:

nozzle means having at least one discharge orifice for discharging a predetermined fluid of said material, a non-electrically connected springlike member having plural coils compressively housed within said nozzle means, said coils having a longitudinal first axis, said member having a longitudinal elongated vibratile extension integral with an end coil of said springlike member, said extension having a longitudinal center second axis and being disposed in said hollow tip and protruding outwardly from said orifice to discharge said photoresist fluid from said orifice as a hollow-shaped stream, said first and second axes being colinear, said fluid being discharged from said orifice along said extension, and a source of pressurized propellant for providing said pressurized propellant external to said orifice to intercept the discharged said fluid, said hollow-shaped stream of said discharged fluid coacting with said intercepting propellant to vibrate said extension transverse to said longitudinal center axis, the vibrations of said extension in combination with said intercepting propellant and said hollow-shaped stream coacting to atomize said fluid into a spray having a uniform distribution characteristic to apply said layer with a substantially uniform thickness on said surface.

2. Spray head apparatus according to claim 1 wherein said spray characteristic further provides a controlled orientation of said spray.

3. Spray head apparatus according to claim 1 wherein said propellant source provides a low pressure propellant.

4. Non-electrostatic spray head apparatus for spraying photoresist as a photoresist layer on the surface of a predetermined circuitizable workpiece, said layer being subsequently finalized as a photoresist mask for coacting with said surface to circuitize said workpiece, said apparatus comprising in combination:

a nozzle having a hollow elongated tip terminating in an orifice for discharging said photoresist as a fluid therefrom, a non-electrically connected springlike member having plural coils compressively housed within said nozzle, said coils having a longitudinal first axis, said member having a longitudinal elongated vibratile extension integral with an end coil of said springlike member, said extension having a longitudinal center axis and being disposed in said hollow tip and protruding outwardly from said orifice to discharge said photoresist fluid from said orifice as a hollow-shaped stream, said first and second axes being colinear, and a source of low pressurized propellant for providing said pressurized propellant external to said orifice to intercept said discharged hollow-shaped stream of said photoresist fluid, said discharged hollow-shaped stream of photoresist fluid coacting with said intercepting propellant to vibrate said extension transverse to said longitudinal center axis, the vibrations of said extension in combination with said intercepting propellant and said hollow-shaped stream coacting to atomize said photoresist fluid into a spray having a uniform distribution characteristic that deposits said layer with a substantially uniform thickness on said surface of said workpiece.

5. Non-electrostatic spray head apparatus for spraying a photoresist layer on the surface of a metallized printed-circuitizable layer of a predetermined substrate, said photoresist layer being subsequently finalized as a photoresist mask for coacting with said surface to circuitize said metallized layer, said apparatus comprising in combination:

a nozzle having a hollow elongated tip terminating in an orifice for discharging said photoresist as a fluid therefrom, a non-electrically connected springlike member having plural coils compressively housed within said nozzle, said coils having a longitudinal first axis, said member having a longitudinal elongated vibratile extension integral with an end coil of said springlike member, said extension having a longitudinal center second axis and being disposed in said hollow tip and protruding outwardly from said orifice to discharge said photoresist from said orifice as a hollow-shaped stream, said first and second axes being colinear, and a source of low pressurized propellant for providing said pressurized propellant external to said orifice to intercept said discharged stream of said photoresist, said hollow-shaped discharged stream coacting with said intercepting propellant to vibrate said extension transverse to said longitudinal center axis, the vibrations of said extension in combination with said intercepting propellant and said hollow-shaped stream coacting to atomize said photoresist into a spray having a uniform distribution characteristic that deposits said photoresist layer with a substantially uniform thickness on said surface of said metallized layer of said substrate.

* * * * *